US006382550B1

(12) United States Patent
Aalto

(10) Patent No.: US 6,382,550 B1
(45) Date of Patent: May 7, 2002

(54) PRESSURE ROLLER REEL-UP

(75) Inventor: Esa Aalto, Hyvinkää (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/582,424

(22) PCT Filed: Dec. 10, 1998

(86) PCT No.: PCT/FI98/00959

§ 371 Date: Jun. 22, 2000

§ 102(e) Date: Jun. 22, 2000

(87) PCT Pub. No.: WO99/35070

PCT Pub. Date: Jul. 15, 1999

(30) Foreign Application Priority Data

Dec. 22, 1997 (FI) ..... 974587

(51) Int. Cl.[7] ..... B65H 18/26
(52) U.S. Cl. ..... 242/547; 242/541.3
(58) Field of Search ..... 242/541, 541.3, 242/541.4, 541.7, 542.3, 547

(56) References Cited

U.S. PATENT DOCUMENTS

| | | | | |
|---|---|---|---|---|
| 3,098,619 | A | | 7/1963 | Washburn |
| 3,471,097 | A | * | 10/1969 | Phelps |
| 4,196,865 | A | * | 4/1980 | Patriksson |
| 4,721,266 | A | | 1/1988 | Haapanen et al. |
| 4,830,304 | A | | 5/1989 | Fuke et al. |
| 4,842,209 | A | * | 6/1989 | Saukkonen |
| 4,883,233 | A | * | 11/1989 | Saukkonen et al. |
| 4,921,183 | A | | 5/1990 | Saukkonen et al. |
| 4,934,620 | A | * | 6/1990 | Rossi |
| 4,951,892 | A | * | 8/1990 | Chaplin et al. |
| 5,150,850 | A | | 9/1992 | Adams |
| 4,746,076 | A | | 5/1998 | Tomma et al. |
| 5,918,830 | A | * | 7/1999 | Verajankorva et al. |

FOREIGN PATENT DOCUMENTS

| | | | | |
|---|---|---|---|---|
| DE | 2516226 | * | 10/1976 | ..... 242/541.3 |
| EP | 0658504 | | 6/1995 | |
| JP | 35561 | * | 11/1975 | ..... 242/541.3 |
| JP | 5089150 | * | 7/1980 | ..... 242/541.3 |
| WO | 9534495 | | 12/1995 | |

* cited by examiner

*Primary Examiner*—William A. Rivera
(74) *Attorney, Agent, or Firm*—Steinberg & Raskin, P.C.

(57) ABSTRACT

The pressure roller reel-up for reeling of a web (W) onto a roll (R) contains a roller (1) via which the continuous web (W) entering the reel-up is arranged to wind around a reeling axle (3) arranged rotatably in a reeling position. The reel-up also comprises a load device (4) for pressing the roller (1) against a roll (R) being formed of the web around the reeling axle (3) in order to form a reeling nip (N) between the roller (1) and the roll (R). The roller (1) is inside a belt loop (2) laid against the periphery of the roll (R) within a given path length (L) after the reeling nip (N) formed between the roller (1) and the roll (R).

15 Claims, 1 Drawing Sheet

PRESSURE ROLLER REEL-UP

FIELD OF THE INVENTION

The present invention relates to a pressure roller reel-up of the type having a roller on which a continuous web entering the reel-up is wound.

BACKGROUND OF THE INVENTION

To accumulate a continuous web, such as a paper web onto a roll a roller over which the web entering the reel-up curves is used in reel-ups. At the same time the roller is in contact with the roll which builds up around the reel spool, and it is loaded against this roll with a suitable force by means of a loading device.

A kind of a pressure roller reel-up is known for instance from the FI patent 71709. In this the roller, which guides the continuous paper web or the like, is pressed with a suitable loading force against the roll formed of the web.

The problem with pressure roller reel-ups is the high linear load which is due to the structure of the nip of the pressure roller that falls in the same size category with the reel spool, which linear load complicates the reeling process and may have a negative effect on the quality of the roll that is being formed. On the other hand, by means of pressure roller reel-ups it is possible to effectively control the air flows before the reeling nip.

OBJECTS AND SUMMARY OF THE INVENTION

The purpose of the invention is to present a pressure roller reel-up by means of which it is possible to control the reeling process more effectively with respect to the load as well. To attain this purpose, the pressure roller reel-up according to the invention is primarily characterized in what will be presented in the characterizing part of the appended claim 1. Together with a belt loop the roller constitutes a structure which guides the web running to the reel-up and presses the web against the roll. Thus, the belt which is situated against the roll within a given length and also participates in the loading with a set surface pressure, generates an extended nip, i.e. the load is not the linear load determined by the pressure roller. Thus, the belt which functions as an extension for the nip, contributes to the optimal structure of the roll. It is possible to affect the reeling with a number of variables, such as for example the length and/or tension of the belt section positioned against the roll.

As for the other preferred embodiments of the invention, reference is made to the appended dependent claims and to the description hereinbelow.

BRIEF DESCRIPTION OF THE DRAWINGS

In the following, the invention will be described in more detail with reference to the appended drawing, in which.

DETAILED DESCRIPTION OF THE INVENTION

Figure 1:
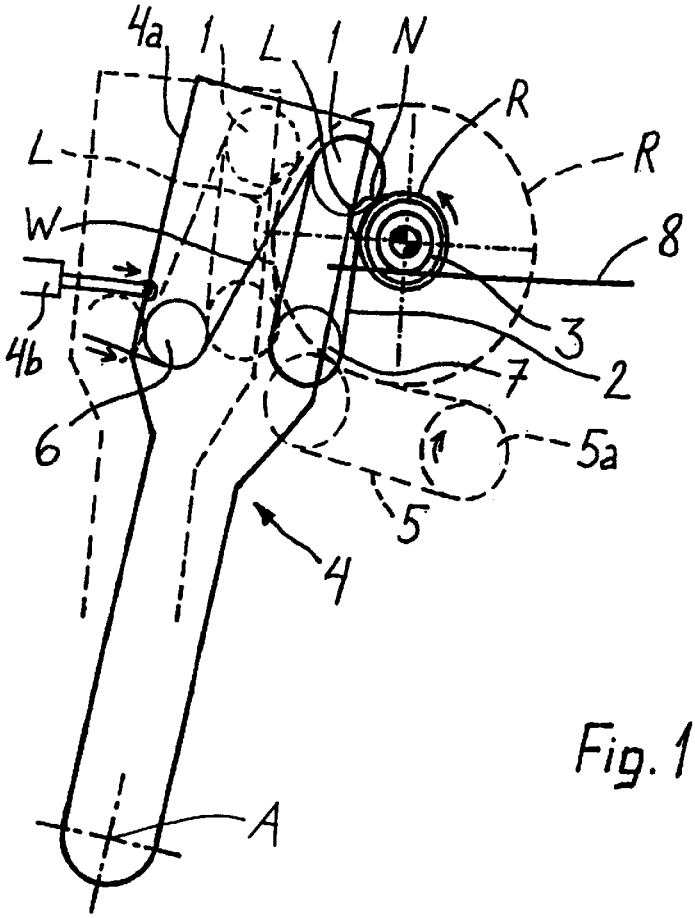
FIG. 1 shows a side view of the roller reel-up in the beginning of the reeling when the roll is in a reeling position.

FIG. 1 shows a pressure roller reel-up which is arranged to reel a continuous paper web W, or the like onto a roll R. The continuously growing roll R builds up around a reel spool, i.e. reeling axle 3 arranged rotatable in the frame (not shown) of the reel-up. According to the principle of the pressure roller reel-up, the reeling axle 3 remains stationary in the reel-up during the reeling as the frame of the reel-up receives the weight of the roll itself as well as the weight caused by the load, but structurally the reeling axle 3 can be located in a part, such as a carriage, or the like, arranged movable in the frame of the reel-up 3 and enabling the transfer of the full roll to an. exit point, and in this context, these structures known as such in connection with the reel-ups, are not described in more detail.

The paper web W or the like is passed onto the roll R via a reeling nip N, which is formed between a roll 1 and the roll R, the roller 1 being loaded over the full width of the roll. Before the reeling nip N, the web curves on the periphery of the roller 1 within a given sector determined by the location of the guide roller 6 preceding the roller 1.

Around the roller 1, a belt loop 2 is tensioned, and thus the reeling nip N which presses the web W against the preceding layers of the roll R, is, in a way, formed between the belt laid on top of the mantle surface of the roller 1 and the roll R. In the travel direction of the web after the roller 1 the web W is pressed against the preceding layers of the roll R by the belt of the belt loop 2 within a given path length L. The belt travels at the same web running speed with the web W. The belt loop 2 is at least equal in width with the entire roll, and it is positioned against the periphery of the roll R within a given wrap length so that it guides the on-coming web W on top of the preceding layers of the roll R formed of the web. Also the belt causes load on the roll, and thus the reeling nip in question is an extended reeling nip located within the path length L in the circumferential direction of the roll R.

That section of the belt loop 2, which is positioned against the roll R, is determined by the roller 1 which forms the actual reeling nip N and by a second roller 7 located in the travel direction of the belt after the roller 1, which second roller 7 turns the travel of the belt in the belt loop towards the first roller 1. The belt of the belt loop 2 leaves the roll R and is guided to the the second roller 7, which is off the roll R, in other words the belt travels a short distance freely from the roll R to the second roller 7. Furthermore, there may be other rollers inside the belt loop 2, for example within the reversing section from the roller 7 to the roller 1. Such a roller can be used for example as a tension roller to adjust the tension of the belt if the rollers 1 and 7 have a fixed position. Naturally, at least one of the rollers 1 and 7 can also be arranged adjustable in its position in the supporting structure to adjust the tension of the belt and/or the wrap length L. Such a roller can be arranged for example in a swinging arm structure, which is pivoted on the structure supporting the rollers and the belt, to turn in a plane perpendicular to the axis of rotation of the roller, or it can be arranged to be moved along guides provided in this structure at the ends of the roller.

The belt loop 2 is advantageously driven, wherein one of the rollers located therein, advantageously the roller 1 forming the reeling nip N, is driven.

As can be seen in FIG. 1, when the thickness of the roll R increases in the radial direction, the roller 1 and the reeling axle 3 move further apart from each other. In practice this is achieved in such a way that the structure supporting the roller 1 and the belt loop 2 around the roller 1 is movable while the reeling axle 3 remains stationary in the frame of the reel-up in the reeling position. Furthermore, in FIG. 1, dashed lines illustrate a situation where the roll R has been reeled into its full size, When the diameter of the roll R increases, the wrap length L on the roll R is increased, if the position of the rollers guiding the belt inside the belt loop is not changed. As was stated above, the geometry and the wrap length L of the belt loop can be adjusted by arranging at least one of the rollers 1 and 7 in such a way that it can be moved in a direction perpedicular to its axis in the structure supporting the rollers.

The structure supporting the rollers 1, 7 and the belt loop 2 is arranged to be loaded by means of a loading device 4 in such a way that a suitable loading force is effective in the reeling nip N and in the section of the belt loop 2 succeeding the reeling nip N. The magnitude of the loading force effected by the loading device is adjustable, and it can vary within the scope of a suitable program while the reeling proceeds. The loading device comprises at least a transfer device 4*a* with which it is possible to move the structure supporting the rollers and the belt loop in the radial direction with respect to the reeling axle 3, and on the other hand a power unit 4*b*, such as a hydraulic cylinder, by means of which it is possible to load this transfer device 4*a* against the roll R with a desired, adjustable force in the direction of the aforementioned transfer movement. The transfer device 4*a* can be a unit which travels along a linear path in linear motion guides and includes a structure supporting the rollers 1, 7 and the belt loop 2, or, as shown in FIG. 1, a swinging arm which is arranged pivotable in the plane of rotation of the reeling axle 3 and whose pivotal axis is located in such a way with respect to the reeling axle 3 that the roller and the belt are placed against the roll R from the side. In FIG. 1, the pivotal axis A is located underneath the level of the reeling axle 3 aside from the vertical plane extending via the reeling axle, and on the same side of the vertical plane where the roller 1 and the belt loop 2 are situated. The power unit 4*b* is arranged to move the swinging arm towards the roll R in order to produce a load. Furthermore, FIG. 1 shows a guide roller 6 which is included in the movable transfer device 4*a* and precedes the belt loop 2 in the travel direction of the web W and guides the web entering the reel-up onto the roller 1. The guide roller is advantageously a spreader roller.

The reeling axle 3 is driven, and thus it is possible to rotate the roll R at a speed required by the web running speed during the entire reeling process at least until the web W passed onto the roll is cut off.

In FIG. 1, dashed lines illustrate a second belt loop 5, having at least the width of the roll R and containing a roller 5*a* which, together with the belt travelling on top of it, forms a nip N' against the roll R. This belt loop 5 can also be loaded against the roll R with a desired force. This second belt loop 5 can be freely rotatable or driven, and its signifigance is disclosed in the description hereinbelow with reference to FIG. 2.

Figure 2:
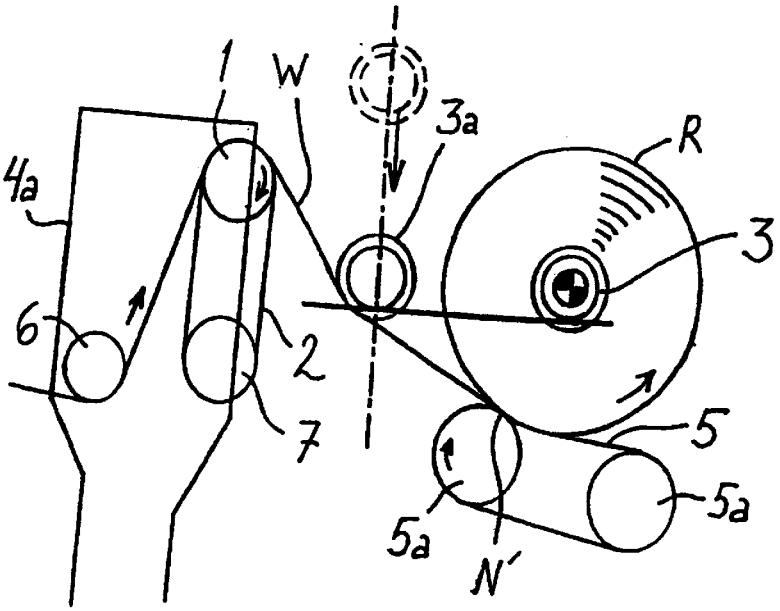
FIG. 2 shows a roller reel-up when the roll is in a change position.

FIG. 2 illustrates a situation where the roll R has become full in the reeling position, and it has been moved further apart from the transfer device 4*a* and off the belt loop 2 along a schematically shown, substantially horizontal transfer path 8. At this final stage, the belt loop 5 which touches the roll R. guides the free run of the web W passed from the roller 1 against the preceding layers of the roll R, and prevents the access of air between the web W and the roll R. The belt loop 5 can be arranged movable with respect to the reeling axle 3, so that it can be accelerated to the web running speed when desired and moved in contact with the outer surface of the roll R. The belt loop 5 can be arranged to move along with the motion of a transfer device such as a carriage or the like which moves the reeling axle 3 from the reeling position of FIG. 1 to the change position of FIG. 2, and the belt loop can be for example fixed to the transfer device.

Furthermore, FIG. 2 shows a change situation, where a new reeling axle 3*a* is brought from above in between the old roll R which is in the change position and the belt loop 2, onto the support of the frame of the reelup, the new reeling axle 3*a* being in contact with the free run of the web W which travels onto the roll R from the roller 1. Now the roller 1 and the belt loop 2 can be brought into contact with the reeling axle 3 by means of the transfer device 4*a*, to form the reeling nip N. in other words in such a way that the web W travels through the nip formed by the belt on the roller 1 and the reeling axle 3. Thereafter the web W can be cut off and its forward end can be guided to wind around the new reeling axle 3*a*, and further under the nip with a method known as such which will not be described in more detail in this context. After the cut-off operation, the rotational motion of the reeling axle is brought to a stop slowly by means of its centre drive. Because the belt loop 5 still binds the surface layers of the web W in the roll, there is no danger that the roll might become slackened. The slow stop reduces the risk of unrolling especially in the case of coated and calendered paper grades.

By means of the second belt loop 5 it is possible to attain the same effect as with the device presented in the international publication WO 95/34495.

The roller 1 forming the actual reeling nip N and the belt loop 2 of the roller 1 are arranged in contact with the roll R from the side. The area of contact is preferably located inside a sector that extends between 0° and 180° in the direction of rotation of the roll R when measured from the uppermost point of the rotating movement. As the reeling process proceeds, the reeling nip N formed by the roller I is located preferably in the area between 0° and 90°. Correspondingly, the second belt loop 5 touches the roll R from underneath. The area of contact where the belt loop rests against the roll R, is located inside a sector that extends between 90° and 270° in the direction of rotation of the roll R when measured from the uppermost point of the rotating movement, and the reeling nip N' located by the roller 5*a* is preferably in the area between 110° and 180°. Naturally, the belt loops 2 and 5 are placed in such a way that they can simultaneously be in contact with the roll R shortly before the roll R is detached from the nip contact with the roller 1 in order to move the full roll R into the change position. The second belt loop 5, the so-called "change belt", does not have strict sequence time requirements, and it can be brought in contact with the roll R at an early stage.

The invention is suitable for all pressure roller reel-ups for web-like materials, especially for paper web reel-ups. The term paper web refers to all such materials in the form of a continuous web which are formed from a fibrous pulp in a paper or board machine and in the reeling of which the invention can be applied, irrespective of the raw material fibres or the grammage.

The belts in the belt loops 2 and 5 have a surface material whose friction with the web material to be reeled is sufficient. Furthermore, the inner surfaces of the belts can be provided with materials or structures which increase the hold with the rollers. One or both of the belt loops may comprise two or more belts side by side instead of one wide belt.

What is claimed is:

1. A pressure roller reel-up comprising:

a reeling axle around which a continuous web is wound to form a roll;

a first roller around which said continuous web passes prior to reaching said reeling axle;

a loading device for enabling the movement of said first roller from a position spaced from said roll to a position in abutment with said roll being formed to thereby define a reeling nip between said first roller and the roll being formed;

a belt arranged around said first roller and a second roller to form a first belt loop, said first belt loop being structured and arranged so that when said first roller is placed against said roll said belt is placed against a periphery of said roll along between said first roller and said second roller a peripheral distance L of said roll after said reeling nip.

2. The pressure reel-up according to claim 1, further comprising means for driving said first belt loop.

3. The pressure reel-up according to claim 1, further comprising a second belt loop structured and arranged to be movable from a position spaced from said roll to a position in abutment with said roll.

4. The pressure reel-up according to claim 3 wherein said second belt loop passes around a roller which forms a nip with the roll in said position in abutment with said roll.

5. The pressure reel up according to claim 3, wherein said second belt loop contacts said roll from underneath said roll within a sector which in the direction of rotation of the roll is between 90° and 270° when measured from the uppermost point of the movement of rotation.

6. The pressure reel-up according to claim 1, wherein said loading device comprises a transfer device having a first end to which is coupled to said first and second roller and a pivotally mounted second end permitting the arcuate movement of said first end of said transfer device.

7. The pressure reel up according to claim 6, wherein said loading device is a swing arm.

8. The pressure reel up according to claim 6, wherein a position of at least one of said first and second rollers is adjustable in said transfer device.

9. The pressure reel up according to claim 1, further comprising a new reeling axle moveable to a position between said roll and said first belt loop when said first roller is spaced from said roll, and when said new reeling axle is placed in said position between said roll and said first belt loop said new reeling axle is placed contact with a run of the web traveling between said roll and said first belt loop.

10. The pressure reel up according to claim 1, wherein when said first roller is placed in abutment with said roll said first belt loop is placed in contact with said roll from the side inside a sector which in the direction of rotation of the roll is between 0° and 180° when measured from an uppermost point of the rotating movement.

11. The pressure reel up according to claim 1, further comprising means for driving said reeling axle.

12. A method for reeling a web in a pressure roller reel-up comprising the steps of:

winding the web around a reeling axle to form a roll;

adjusting a position of a belt loop having a belt and a first and second roller to a position wherein said first roller is placed in abutment with said roll to define a reeling nip and said belt is laid against a periphery of said roll from said first roller along a length L of said periphery of said roll;

applying a loading force to said roll by means of said belt loop, said loading force effective at said reeling nip and along said length L.

13. The method according to claim 12, further comprising adjusting a geometry of said belt loop by moving one of said first and second rollers.

14. The method according to claim 12, further comprising:

moving a full roll away from said belt loop while said web is running on to said full roll;

positioning a new reeling axle into contact with a free run of the web between said belt loop and said full roll;

positioning said first roller so that the web travels between said first roller and said new reeling axle;

cutting the web at a forward end thereof and guiding said forward end to wind around said new reeling axle.

15. The method according to claim 14, further comprising positioning a second belt loop in contact with said full roll and applying a force to said full roll via said second belt loop to stop the rotation of said full roll.

* * * * *